United States Patent [19]

King

[11] Patent Number: 4,597,888

[45] Date of Patent: Jul. 1, 1986

[54] CLEANER FOR STEEL CANS

[75] Inventor: Peter F. King, Farmington Hills, Mich.

[73] Assignee: Parker Chemical Company, Madison Heights, Mich.

[21] Appl. No.: 746,430

[22] Filed: Jun. 19, 1985

[51] Int. Cl.[4] ..... C11D 3/075

[52] U.S. Cl. ..... 252/135; 252/156; 252/174.21; 252/174.22; 252/DIG. 14

[58] Field of Search ..... 252/156, 135, 174.21, 252/174.22, 99, DIG. 14

[56] References Cited

U.S. PATENT DOCUMENTS

| | | | |
|---|---|---|---|
| 3,061,552 | 10/1962 | Schenck et al. | 252/135 |
| 3,255,118 | 6/1966 | Carroll et al. | 252/135 |
| 3,437,697 | 4/1969 | Hodgkiss et al. | 252/156 |
| 4,349,448 | 9/1982 | Steele | 252/135 |
| 4,382,825 | 5/1983 | McCready | 134/2 |
| 4,390,465 | 6/1983 | Spekman | 252/527 |

FOREIGN PATENT DOCUMENTS

| | | |
|---|---|---|
| 1445716 | 8/1976 | United Kingdom . |

*Primary Examiner*—Prince E. Willis

*Attorney, Agent, or Firm*—Arthur E. Kluegel

[57] ABSTRACT

An alkaline cleaner particularly useful for cleaning steel cans containing an alkali metal silicate, an alkali metal phosphate, a sequestering agent, an ethoxylated linear alcohol and a chloride derivative of a polyethoxylated phenol or a polyethoxylated aliphatic alcohol.

23 Claims, No Drawings

CLEANER FOR STEEL CANS

BACKGROUND OF THE INVENTION

The present invention relates to a low foaming alkaline cleaner well suited for cleaning metals. More specifically, the present invention relates to a low foaming cleaner especially well adapted for cleaning steel cans such as black plate cans and tin plated steel cans.

Ferrous-based metals such as steel and tin plated steel are commonly used in making containers such as cans. Such metals generally have a protective oil on the steel surface to protect the surface from abrasion and/or corrosion. Lubricants may also be coated onto the metal surfaces to facilitate forming of the metal into containers. While lubricants are useful in protecting the steel and in facilitating forming operations, the lubricants often must be removed before use is made of the containers. One method and cleaner composition for removal of lubricants is taught in U.S. Pat. No. 4,382,825 which issued May 10, 1983 to McCready. The McCready patent relates to an alkaline cleaner for drawn and ironed black plate steel which includes an alkali metal metasilicate, orthosilicate or combination thereof, optionally an alkali metal carbonate, an alkali metal phosphate, a surfactant such as nonylphenoxy-(polyethoxy) ethanol, and a polyethoxy secondary alcohol. Another example of an alkaline cleaner is that of U.S. Pat. No. 4,349,448 which issued Sept. 14, 1982 to Steele. The Steele patent teaches a low temperature, low foaming alkaline cleaner comprising an alkaline material, an ethoxylated alkyl phenol and an ethoxylated and propoxylated alkyl phenol.

However, there remains a need for improved cleaners. Many metal cleaning operations are conducted on a continuous, line basis and require low foaming, highly efficient cleaners. ALso, cleaners which are employed to clean steel cans such as black plate cans or tin plated steel cans should provide cans which have a pleasing appearance and which are suitable for use, for example, as food containers.

It is an object of the present invention to provide a highly efficient cleaner suitable for both black plate and tin plate surfaces. Further understanding of the present invention will be had from the following disclosure. All percentages and parts herein are by weight unless otherwise indicated.

SUMMARY OF THE INVENTION

An alkaline cleaner composition comprising:

(a) from about 0.5 to about 25 parts of an alkali metal silicate;

(b) from about 0.1 to about 3.0 parts of an alkali metal phosphate;

(c) from about 0.1 to about 3.0 parts of a sequestering agent;

(d) from about 0.05 to about 1.5 parts of an ethoxylated linear alcohol; and (e) from 0.05 to about 1.5 parts of a chloride derivative of a nonionic surfactant selected from the group consisting of a polyethoxylated phenol, a polyethoxylated aliphatic alcohol and mixtures thereof.

DETAILED DESCRIPTION OF THE INVENTION

The present invention provides an alkaline cleaner and process especially well adapted for cleaning ferrous-based metal surfaces such as black plate steel and tin plate containers. The alkaline cleaner comprises an alkali metal silicate, an alkali metal phosphate, a sequestering agent, an ethoxylated linear alcohol and the chloride derivative of a nonionic surfactant selected from the group consisting of a polyethoxylated phenol, a polyethoxylated aliphatic alcohol and mixtures thereof. Optionally, the cleaner can also comprise an additional defoaming agent.

The alkali metal silicate component of the present invention is preferably a metasilicate, and more preferably, is sodium metasilicate. Other suitable alkali metal silicates which can be employed include, for example, potassium orthosilicate. The cleaner composition comprises from about 0.5 to about 25, preferably about 0.5 to about 17.5, and more preferably from about 1.5 to about 6 parts of alkali metal silicate. Suitable amounts of alkali metal silicate in the working cleaner solution are from about 0.5 g/l to about 25 g/l, preferably from about 0.5 g/l to about 12.5 g/l, and more preferably from about 1.5 g/l to about 6 g/l.

The alkali metal phosphate component of the present invention is preferably a polyphosphate, and more preferably is sodium tripolyphosphate. Other suitable alkali metal condensed phosphates which can be employed include, for example, sodium or potassium pyrophosphate. The cleaner composition comprises from about 0.1 to about 3.0, preferably from about 0.1 to about 1.5, and more preferably from about 0.15 to about 0.75 parts of alkali metal phosphate. Suitable amounts of alkali metal phosphate in the working cleaner solution are from about 0.1 g/l to about 3.0 g/l, preferably from about 0.1 g/l to about 1.5 g/l, and more preferably from about 0.15 g/l to about 0.75 g/l.

The sequestering agent is preferably an alkali metal gluconate, and more preferably is sodium gluconate. Other suitable sequestering agents which can be employed include sodium citrate, EDTA (ethylenediaminetetraacetic acid), lithium gluconate and potassium gluconate. The cleaner composition comprises from about 0.1 to about 3.0, preferably from about 0.1 to about 1.5, and more preferably from about 0.15 to about 0.75 parts of sequestering agent. Suitable amounts of sequestering agent in the working cleaner are from about 0.1 g/l to about 3.0 g/l, preferably from about 0.1 g/l to about 1.5 g/l, and more preferably from about 0.15 g/l to about 0.75 g/l.

The ethoxylated linear alcohol of the present invention preferably has from about 11 carbon atoms to about 15 carbon atoms in the alcohol moiety which is ethoxylated with from about 7 moles to about 12 moles of ethylene oxide. A preferred ethoxylated linear alcohol for use herein is Tergitol 15-S-9 which is commercially available from Union Carbide. The cleaner composition comprises from about 0.05 to about 1.5, preferably from about 0.05 to about 0.75, and more preferably from about 0.05 to about 0.5 parts of ethoxylated linear alcohol. Suitable amounts of ethoxylated linear alcohol present in the working cleaner solution are from about 0.05 g/l to about 1.5 g/l, preferably from about 0.05 g/l to about 0.75 g/l, and more preferably from about 0.05 g/l to about 0.5 g/l.

The chloride derivative of a nonionic surfactant selected from the group consisting of a polyethoxylated phenol, a polyethoxylated aliphatic alcohol and mixtures thereof is preferably one characterized by the following general formula:

$$R-(OCH_2\overset{\overset{R_1}{|}}{C}H)_nCl$$

wherein R is an alkyl group of about 8 to about 18 carbon atoms, a phenyl group or a napthyl group substituted by 1 or 2 alkyl groups of from about 8 to about 18 carbon atoms, $R_1$ is a hydrogen, a methyl group or an ethyl group, and n represents a positive integer of from about 2 to about 100.

A preferred chloride derivative is Antarox LF 330 available commercially from General Aniline and Film Corporation. The cleaner composition comprises from about 0.05 to about 1.5, preferably from about 0.05 to about 0.75, and more preferably from about 0.05 to about 0.5 parts of the chloride derivative. Suitable amounts of the chloride derivative in the working cleaner solution are from about 0.05 g/l to about 1.5 g/l, preferably from about 0.05 g/l to about 0.75 g/l, and more preferably from about 0.05 g/l to about 0.5 g/l.

If unusually high foaming conditions exist such as may occur at high spray pressures, a defoaming agent may be employed in the cleaner composition of the present invention. An oil-based floating defoamer such as one comprising microcrystalline wax is suitable. Examples of suitable defoaming agents include Quaker Additive DF-B, Antarox LF-330 from Rohm and Haas, Trycol LF-1 from Emery and Pluronic L-61 from BASF-Wyandotte. The defoaming agent should be used in an amount effective to prevent foaming of the cleaner.

The cleaner composition can be provided in concentrate form and then diluted with water to a working solution. In one form, the concentrate can be made as two separate compositions which can be combined to make up the cleaner of this invention. For example, one concentrate composition could comprise the alkali metal silicate, alkali metal phosphate and sequestering agent, and another concentrate composition could comprise the ethoxylated linear alcohol, the chloride derivative of polyethoxylated phenol or polyethoxylated aliphatic alcohol or mixtures thereof, water and a pH adjusting agent. In another form, the concentrate can be made in one composition in an all solids dry mix. In this latter case, sodium carbonate, sodium bicarbonate or sodium sesquicarbonate are preferably added to the mix to provide a free flowing dry mix.

For the working cleaner solution for cleaning black plate or the like, the total amount of the ingredients of the composition can be employed in an amount of from about 1 g/l to about 30 g/l solids, preferably from about 1 g/l to about 14 g/l solids, and more preferably from about 3.5 g/l to about 7.5 g/l solids. The working cleaner solution should have a pH in the range of from about 10.5 to about 13 and preferably has a pH of from about 11.5 to about 12.5. If necessary, the pH can be adjusted by further dilution with water, addition of more cleaner or addition of any suitable pH adjusting agent such as are well known in the art.

While the working solution can be employed as a cleaner solution in any conventional technique, preferably the substrate to be cleaned is a steel can such as a black plate or tin plate can and the following cleaning process is employed:

(1) pre-wash;

(2) clean the can with a working cleaner solution of this invention by spraying at 65° C. for 30–60 seconds; and (3) rinse the can for 15–30 seconds with water at ambient temperature.

Of course, the cleaner solution of the present invention can be employed to clean black plate or tin plate other than steel cans and, of course, for cleaning other substrates. The temperature of the working cleaner solution is preferably maintained in the range of from 45° C. to about 80° C. and more preferably from about 55° C. to about 70° C. The solution should be in contact with the substrate to be cleaned for from about 15 seconds to about 5 minutes with from about 30 seconds to about 2 minutes being preferred. Following contact of the substrate by the cleaning solution, the substrate surfaces should be rinsed with water and then can be further treated as desired and as is conventional in the art.

It will be appreciated that other components may be optionally added to the composition depending upon the use of the cleaner. For example, the composition can optionally contain an anti-corrosive material such as an amine, borate, nitrate, and the like.

The cleaner solution can be used to remove a wide variety of materials such as oils and soaps that are built up on the metal. Examples of oils which can be removed by the present cleaner include paraffinic sulfurized oils, chlorinated sulfonate oils and the like.

Having now described the invention in general, the following examples are offered to further illustrate the present invention.

EXAMPLE 1

A first concentrate is made by mixing the following ingredients:

| Ingredient | Parts by Weight |
|---|---|
| Sodium tripolyphosphate | 1 |
| Sodium metasilicate hydrate | 8 |
| Sodium gluconate | 1 |

A second concentrate is made by mixing the following ingredients.

| Ingredient | Parts by Weight |
|---|---|
| Antarox LF 330 | 1 |
| Tergitol 15-S-9 | 1 |
| Water | 1 |
| $NH_4OH$ | To pH 10.5 |

0.5 oz. per gallon of concentrate 1 is mixed with 0.07 oz. per gallon of concentrate 2 to provide a working cleaner solution. The working cleaner solution is sprayed onto black plate cans at a temperature of about 65° C. and for a time of contact of about 1 minute. The cans were rinsed, D.I. water rinsed, and were determined to be waterbreak-free before and after drying.

EXAMPLES 2–13

Aqueous working cleaner solutions are made up to the concentrations set forth below in grams per gallon. The cleaner solutions are sprayed into tin plate steel cans for about 40 seconds at a spray pressure of 30 to 35 psi and at the temperatures set forth below. The cans were rinsed, D.I. water rinsed and evaluated with the results set forth below:

| Type Can / Ingredient | EXAMPLE 2 | 3 | 4 | 5 | 6 | 7 | 8 | 9 | 10 | 11 | 12 | 13 |
|---|---|---|---|---|---|---|---|---|---|---|---|---|
| | Tin Plated Steel Cans "A" With Lubricant E. H. Mack & Co. 628B | | | | | | | | Tin Plated Steel Cans "A" With Lubricant E. H. Mack & Co. 623A & 544A | | Tin Plated Steel Cans "B" With Lubricant E. H. Mack & Co. 544A | |
| Sodium Silicate | 10.6 | 21.2 | 21.2 | 10.6 | 5.3 | 5.3 | 5.3 | 4.25 | 4.25 | 4.25 | 4.25 | 4.25 |
| Sodium Gluconate | 1.4 | 2.8 | 2.8 | 1.4 | 0.7 | 0.7 | 0.7 | 0.56 | 0.56 | 0.56 | 0.56 | 0.56 |
| Sodium Tripoly-phosphate | 1.4 | 2.8 | 2.8 | 1.4 | 0.7 | 0.7 | 0.7 | 0.56 | 0.56 | 0.56 | 0.56 | 0.56 |
| Antarox LF330 | 0.28 | 0.56 | 0.56 | 0.28 | 0.34 | 0.54 | 0.54 | 0.31 | 0.31 | 0.31 | 0.31 | 0.51 |
| Tergitol 15-S-9 | 0.28 | 0.56 | 0.56 | 0.28 | 0.34 | 0.54 | 0.54 | 0.31 | 0.31 | 0.31 | 0.31 | 0.31 |
| Pluronic L61 (defoamer) | — | 0.06 | 0.18 | 0.09 | 0.16 | 0.32 | 0.32 | 0.30 | 0.30 | 0.30 | 0.31 | 0.60 |
| pH | 12.35 | 12.40 | 12.40 | 12.20 | 11.95 | 11.92 | 11.82 | 12.35 | 12.30 | 12.20 | 12.20 | 12.15 |
| T °C. | 62° | 62° | 57° | 57° | 57° | 57° | 51° | 51° | 51° | 65° | 62° | 62° |
| foam | 6–8" | 6" | 6" | 6" | — | 4" | — | 2" | — | — | — | — |
| wetbreak | Yes | No | Yes | Slight | Slight | No | Slight | No | No | No | Slight | Yes |
| detinning | No | Yes | Slight | Slight | No | No | No | Accep. | No | No | No | No |

What is claimed is:

1. An alkaline cleaner composition comprising:
(a) from about 0.5 to about 25 parts by weight of an alkali metal silicate;
(b) from about 0.1 to about 3.0 parts by weight of an alkali metal phosphate;
(c) from about 0.1 to about 3.0 parts by weight of a sequestering agent;
(d) from about 0.05 to about 1.5 parts by weight of an ethoxylated linear alcohol;
(e) from 0.05 to about 1.5 parts by weight of a chloride derivative of a nonionic surfactant selected from the group consisting of a polyethoxylated phenol, a polyethoxylated aliphatic alcohol and mixtures thereof.

2. The composition of claim 1 wherein said ethoxylated linear alcohol has from about 8 to about 18 carbon atoms ethoxylated with from about 7 to about 11 moles ethylene oxide.

3. The composition of claim 2 wherein said chloride derivative is characterized by the following general formula:

$$R-(OCH_2\overset{\overset{R_1}{|}}{C}H)_nCl$$

wherein R is an alkyl group of from 8 to about 18 carbon atoms, a phenyl group, or a napthyl group substituted by 1 or 2 alkyl groups of from about 8 to about 18 carbon atoms, $R_1$ is hydrogen, a methyl group or an ethyl group, and n represents a positive integer of from about 2 to about 100.

4. The composition of claim 3 wherein said composition is in an aqueous alkaline cleaner composition having a pH of from about 10.3 to about 13.

5. The composition of claim 4 wherein said alkali metal silicate is an alkali metal metasilicate.

6. The composition of claim 5 wherein said alkali metal phosphate is an alkali metal polyphosphate.

7. The composition of claim 6 wherein said sequestering agent is an alkali metal gluconate.

8. The composition of claim 7 having a solids content of from about 1 g. per liter to about 30 g. per liter.

9. The composition of claim 8 wherein said alkali metal silicate is sodium metasilicate hydrate.

10. The composition of claim 9 wherein said alkali metal polyphosphate is sodium tripolyphosphate.

11. The composition of claim 10 having a solids content of from about 1 g. per liter to about 15 g. per liter.

12. The alkaline cleaner composition of claim 1 comprising:
(a) from about 0.5 to about 12.5 parts by weight of said alkali metal silicate;
(b) from about 0.1 to about 1.5 parts by weight of said alkali metal phosphate;
(c) from about 0.1 to about 1.5 parts by weight of said sequestering agent;
(d) from about 0.05 to about 0.75 parts by weight of said ethoxylated linear alcohol; and
(e) from about 0.05 to about 0.75 parts by weight of said chloride derivative of a nonionic surfactant.

13. The alkaline cleaner composition of claim 12 comprising:
(a) from about 1.5 to about 6 parts by weight of said alkali metal silicate;
(b) from about 0.15 to about 0.75 parts by weight of said alkali metal phosphate;
(c) from about 0.15 to about 0.75 parts by weight of said sequestering agent;
(d) from about 0.05 to about 0.5 parts by weight of said ethoxylated linear alcohol; and
(e) from about 0.05 to about 0.5 parts by weight of said chloride derivative of a nonionic surfactant.

14. An alkaline cleaner composition comprising:
(a) from about 0.5 to about 25 parts by weight of an alkali metal silicate;
(b) from about 0.1 to about 3.0 parts by weight of an alkali metal phosphate;
(c) from about 0.1 to about 3.0 parts by weight of a sequestering agent;
(d) from about 0.05 to about 1.5 parts by weight of an ethoxylated linear alcohol having from about 8 to about 18 carbon atoms ethoxylated with from about 7 to about 11 moles ethylene oxide;
(e) from about 0.05 to about 1.5 parts by weight of a compound characterized by the following general formula:

$$R-(OCH_2\overset{\overset{R_1}{|}}{C}H)_nCl$$

wherein R is an alkyl group of from 8 to about 18 carbon atoms, a phenyl group, or a napthyl group substituted by 1 or 2 alkyl groups of from about 8 to about 18 carbon atoms, $R_1$ is hydrogen, a methyl group or an ethyl group, and n represents a positive integer of from about 2 to about 100;

(f) a defoaming agent.

15. The composition of claim 14 wherein said composition is an aqueous alkaline cleaner composition having a pH of from about 10.5 to about 13.

16. The composition of claim 15 wherein said alkali metal silicate is an alkali metal metasilicate.

17. The composition of claim 16 wherein said alkali metal phosphate is an alkali metal polyphosphate.

18. The composition of claim 17 wherein said sequestering agent is an alkali metal gluconate.

19. The composition of claim 18 having a solids content of from about 1 g. per liter to about 30 g. per liter.

20. The alkaline cleaner composition of claim 19 comprising:

(a) from about 0.5 to about 12.5 parts by weight of said alkali metal silicate;

(b) from about 0.1 to about 1.5 parts by weight of said alkali metal phosphate;

(c) from about 0.1 to about 1.5 parts by weight of said sequestering agent;

(d) from about 0.05 to about 0.75 parts by weight of said ethoxylated linear alcohol; and (e) from about 0.05 to about 0.75 parts by weight of said chloride derivative of a nonionic surfactant.

21. The alkaline cleaner composition of claim 20 comprising:

(a) from about 1.5 to about 6 parts by weight of said alkali metal silicate;

(b) from about 0.15 to about 0.75 parts by weight of said alkali metal phosphate;

(c) from about 0.15 to about 0.75 parts by weight of said sequestering agent;

(d) from about 0.05 to about 0.5 parts by weight of said ethoxylated linear alcohol; and (e) from about 0.05 to about 0.5 parts by weight of said chloride derivative of a nonionic surfactant.

22. The composition of claim 21 having a solids content of from about 1 g. per liter to about 14 g. per liter.

23. The composition of claim 12 wherein said defoaming agent comprises microcrystalline wax.

* * * * *

UNITED STATES PATENT AND TRADEMARK OFFICE

CERTIFICATE OF CORRECTION

PATENT NO. : 4,597,888

DATED : July 1, 1986

INVENTOR(S) : Peter F. King

It is certified that error appears in the above-identified patent and that said Letters Patent are hereby corrected as shown below:

| | |
|---|---|
| At column 1, line 37 | the word --ALso-- should be "Also" |
| At column 6 in the example chart under no. 13 | the number --0.31-- should be "0.51" |

Signed and Sealed this

Eighteenth Day of November, 1986

*Attest:*

DONALD J. QUIGG

*Attesting Officer* *Commissioner of Patents and Trademarks*